United States Patent [19]

Conlon

[11] 4,239,008

[45] Dec. 16, 1980

[54] LIGHTWEIGHT RAILWAY CAR HATCH COVER

[75] Inventor: Edward B. Conlon, Garnerville, N.Y.

[73] Assignee: Baltek Corporation, Northvale, N.J.

[21] Appl. No.: 952,100

[22] Filed: Oct. 17, 1978

[51] Int. Cl.[3] ..... B61D 7/00; B61D 17/16; B61D 39/00

[52] U.S. Cl. ..... 105/377; 49/52; 52/404; 105/247; 114/201 R; 428/496

[58] Field of Search ..... 49/402, 52; 52/200, 52/309.13, 309.14, 309.15, 309.9, 404; 73/146.8; 105/377, 247; 114/201 R, 203; 428/425.1, 496

[56] References Cited

U.S. PATENT DOCUMENTS

| | | | |
|---|---|---|---|
| 1,241,385 | 9/1917 | Hunt | 114/201 R |
| 1,777,880 | 10/1930 | Ewertz et al. | 114/201 R |
| 2,970,347 | 2/1961 | Massopust | 105/377 X |
| 2,983,401 | 5/1961 | Murphy | 52/404 X |
| 3,605,639 | 9/1971 | Ingram | 105/377 |
| 3,605,679 | 9/1971 | Voland | 73/146.8 X |
| 3,796,168 | 3/1974 | Zeller | 105/377 |

*Primary Examiner*—Howard Beltran
*Attorney, Agent, or Firm*—Michael Ebert

[57] ABSTRACT

A set of hinged covers adapted to sealably close the rectangular hatch on the roof of a railway hopper car having a coaming running along the hatch perimeter. Each cover has a vaulted formation to shed water, the long edges of the cover being rolled to define canopies which protectively shield the coaming and a compressible gasket secured to the underside of the cover which presses against the coaming to effect a seal against contaminants. The cover structure is a sandwich laminate of high rigidity and strength constituted by an end grain balsa wood core panel to whose faces are bonded fiberglass skins. The skins are extended beyond the ends of the panel and are interlaminated to define channel-shaped end flanges which cooperate with hinged hold-down bars having an opposed channel formation within which a compressible gasket is nested to seal the ends of the cover.

7 Claims, 9 Drawing Figures

G1
G2
G3
G4
G5
G6
G7
13C
N1
N2
N3
N4
N5
N6
N7
OG1
OG2
OG3
OG4
OG5
16
16A
16B

LIGHTWEIGHT RAILWAY CAR HATCH COVER

BACKGROUND OF INVENTION

This invention relates generally to hatch covers for railway hopper cars, and more particularly to a hatch cover constituted by a structural sandwich laminate in which a balsa wood core panel is interposed between fiberglass facing skins.

The conventional railway hopper car is loaded through a roof hatch which is centered on the roof and straddled by narrow walkways, the hatch being closed by hinged hatch covers. The typical hopper car has one continuous hatch extending almost the full length of the roof and a set of hinged hatch covers fabricated of steel and arranged in tandem, each cover closing a respective portion of the hatch.

Steel hatch covers are heavy and cumbersome, and in order to provide covers which can be manually raised and lowered without difficulty, each steel cover must be relatively short to provide a workable weight. Hence several steel covers are normally required to close the entire roof hatch of a hopper car.

In recent years, efforts have been made to replace steel hatch covers with light-weight covers molded of fiberglass-reinforced plastic material. A molded plastic hatch cover has many advantages over steel; for it is corrosion-resistant and much lighter in weight; it is easier to move between its opened and closed positions so that fewer covers of an appropriate length may be used to close a hopper car hatch. Moreover, by using reinforced fiberglass hatch covers, one thereby substantially reduces the overall unloaded weight of the hopper car.

Where the molded fiberglass reinforced plastic hatch cover is of one-piece construction, as disclosed, for example, in the Zeller U.S. Pat. No. 3,796,168, it then possesses an inherent flexibility. This makes it difficult to maintain a weather-tight seal between the cover and hatch unless one provides many closely-spaced clamps located about the entire periphery of the cover. As noted in the Zeller patent, since these plastic covers range in size up to 14 feet in length, while being only 2½ feet wide, the necessity for so many clamps renders such plastic covers impractical, not only because of the cost entailed by a large number of clamps, but also due to the working time required to lock and release the clamps.

Moreover, should one of the clamps be left unclamped—a not uncommon occurrence—dirt, rain and water are then free to enter the hopper car interior and may ruin the cargo stored therein. Zeller seeks to solve this problem by adding weather stripping to his one-piece fiberglass reinforced plastic panel, but this solution does not overcome other drawbacks of a hatch cover of this type arising from its inherent flexibility and structural weakness.

The Ingram U.S. Pat. No. 3,605,639 points out that fiberglass plastic hatch covers of the type then known not only lack the rigidity of metal covers, but that they are prone to cracking when thrown open to one side against a roof walkway. To overcome these problems, Ingram provides a fiberglass hatch cover of hollow construction, the light-weight cover being reinforced by internal fiberglass trusses to impart rigidity and improved load-bearing strength thereto. While trussed covers of the Ingram type have obvious advantages over single-piece plastic covers, their construction entails a relatively complex and costly manufacturing procedure.

SUMMARY OF INVENTION

In view of the foregoing, the main object of this invention is to provide light-weight, non-metallic hatch covers for railway hopper cars, which covers are characterized by an exceptionally high degree of rigidity and structural strength.

More particularly, it is an object of this invention to provide a hatch cover formed by a structural sandwich laminate having an end grain balsa wood core panel interposed between fiberglass facing skins, the cover having a vaulted formation to shed water.

Yet another object of this invention is to provide a hatch cover having minimal hardware requirements, whereby the cover may be quickly and easily latched and unlatched.

Also an object of this invention is to provide a hatch cover whose underside has compressible gaskets secured thereto which cooperate with a coaming running along the periphery of the hatch to create a weather-tight seal preventing contamination of the cargo.

Among the significant features and advantages of a hatch cover in accordance with the invention are the following:

A. Because of the light weight and high strength of the cover, it becomes possible to fit a typical hopper car having a hatch of about 48 feet in length with a set of only two covers, each being half the hatch length, yet weighing less than 100 pounds complete with hardware attachments. Thus a single man is able, without difficulty, to raise and lower each cover.

B. Because of its laminate strength, the cover can withstand concentrated loads placed anywhere on the cover as high as 300 lbs., or loads of 15 lbs. per square foot placed anywhere over the entire cover.

C. Because of the inherent thermal insulation properties of the balsa core, the laminate cover thermally protects the cargo in the hopper car, the cover being operable within a very broad temperature range (i.e., +300° F. to −50° F. and below).

D. Because the cover has a non-skid surface, it is possible for railway personnel to walk safely thereon.

E. Because the edges of the cover are rolled, they define canopies which protectively shield the coaming and the gasket pressed thereagainst.

F. Because the core of the laminate is formed from a single panel of balsa wood whose long edges are slit to permit the formation of the rolled edges, the covers may be mass-produced at low cost.

Briefly stated, these objects are attained by a set of at least two hinged covers adapted to sealably close the rectangular hatch on the roof of a railway hopper car having a metal coaming running along the periphery of the hatch. Each cover has a vaulted formation to shed water and rolled edges to define canopies which protectively shield the coaming and the gaskets secured to the underside of the cover which engage the coaming to seal the hatch.

The cover structure is a sandwich laminate constituted by an end grain balsa wood core panel to whose facings are resin-laminated fiberglass skins, the long edges of the panel being slit to permit rolling thereof to define the protective canopies, the laminating resin penetrating and filling the triangular notches formed by the slits when the balsa panel edges are rolled.

The skins are extended beyond the ends of the core panel and are interlaminated to define channel-shaped end flanges. These flanges cooperate with hinged hold-down bars each having an opposed channel formation within which a compressible gasket is nested which engages and seals the cover end flange.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
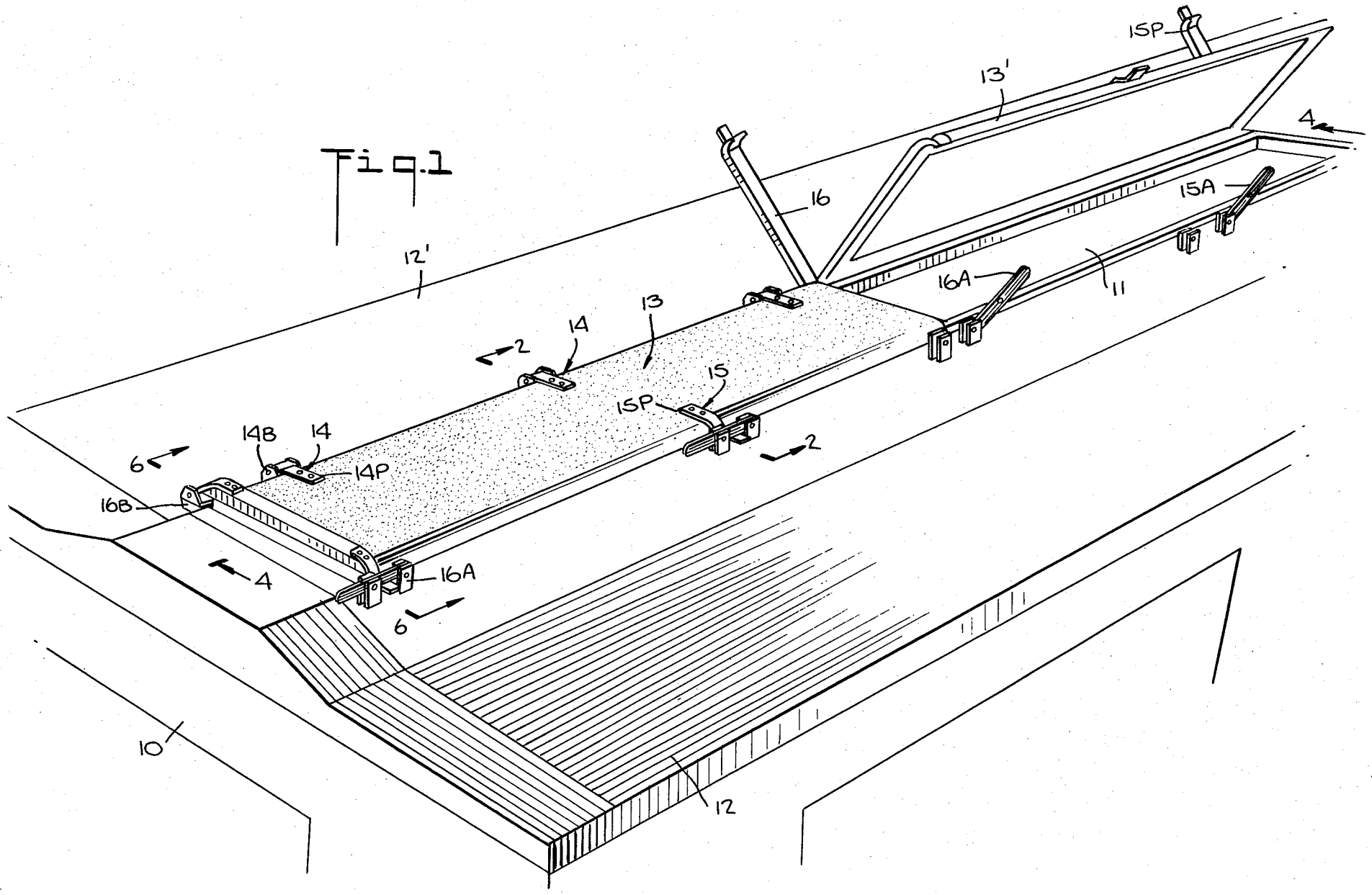
FIG. 1 is a perspective view of a portion of the roof of a standard railway hopper can fitted with a set of hatch covers in accordance with the invention.

Referring now to FIG. 1, there is shown a conventional railway hopper car 10 whose roof is provided with a continuous rectangular hatch 11 which runs almost the full length thereof, the hatch being symmetrically-disposed relative to the longitudinal center line of the roof. On either side of the hatch are cat walks 12 and 12'.

The hatch is covered by a set of like hatch covers, generally designated by numerals 13, 13', etc., cover 13 being shown closed and cover 13' being shown open. While FIG. 1 illustrates roughly one half of a standard hopper car, with two covers closing one half of the hatch therein, which means that a set of four covers would be required to entirely close the hatch, this by way of illustration only.

In practice, since the covers are exceptionally lightweight, it becomes possible to provide a set of two covers for the full hatch length. Thus with a hopper car hatch opening of 24 inches in width and 47 feet, 8 inches in length, in one practical embodiment of the invention, this hatch can be covered by a pair of covers having a length of 23 feet 11-11/16 inches in length and 31½ inches in width.

Each cover is hinged to the roof of the car on the cat walk 12' side, this being effected by a group of three equispaced hinges 14 whose swing plates 14P are screwed or otherwise attached to the left edge of the cover and whose pivot bearings 14B are secured to the roof. Each cover is provided at its midpoint with a single latch 15 whose latch plate 15P is secured to the cover at the right edge thereof and whose locking arms 15A are attached to the roof at the cat walk 12 side.

The ends of covers 13 are engaged by hold-down bars 16 whose hinge bearings 16B are attached to the roof at the cat walk 12' side and whose locking arms 16A are secured to the roof at the cat walk 12 side. Thus to release a cover, one has only to unlatch a single latch and two hold-down bars, permitting the operator to raise the cover which can now be folded down on the left cat walk 12'. The latches and hinges may be of any commercially-available type which comply with existing hopper car hardware standards.

Figure 2:
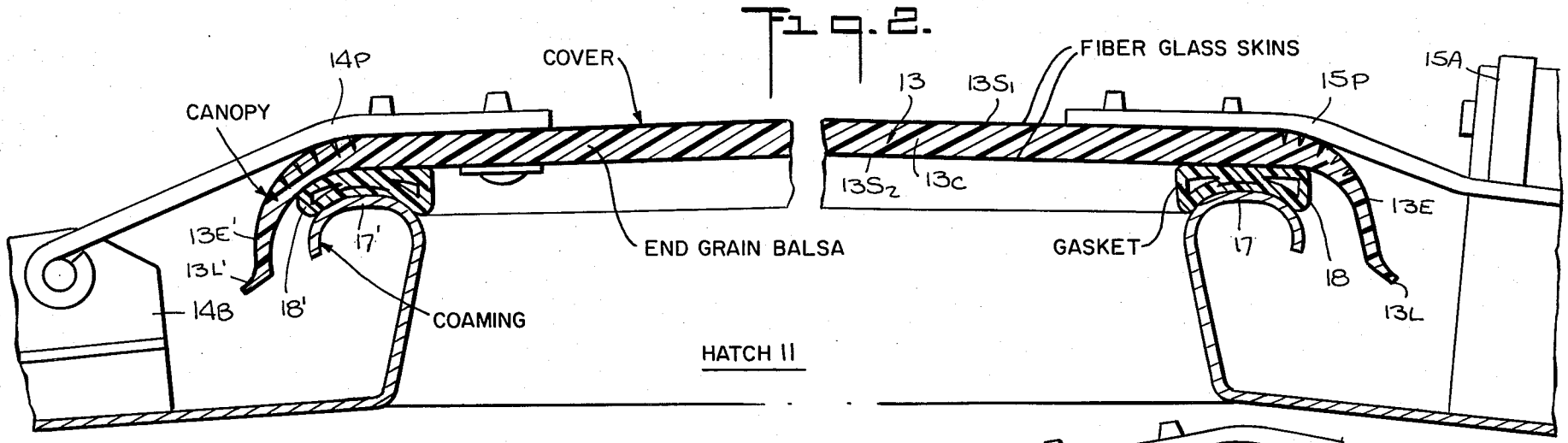
FIG. 2 is a transverse section taken in the plane indicated by lines 2—2 in FIG. 1.

Referring now to FIG. 2, it will be seen that hatch 11 is provided along its long sides with a metal coaming 17 and 17' and that coaming 17 on the right side of the hatch is engaged by a complementary gasket 18 secured to the underside of cover 13 adjacent its right edge. Coaming 17', at the left side of the hatch, is similarly engaged by a gasket 18' on the underside of the cover adjacent its left edge.

The gaskets serve to effectively seal the hatch against contaminants of the type encountered in railway operations (i.e., dirt, snow or water). The gaskets are preferably extruded of neoprene (polychloroprene) or similar synthetic elastomeric material which includes additives that render the gasket mildew and fungus-resistant, as well as resistant to ozone, oil, water, aging and cracking.

Figure 3:
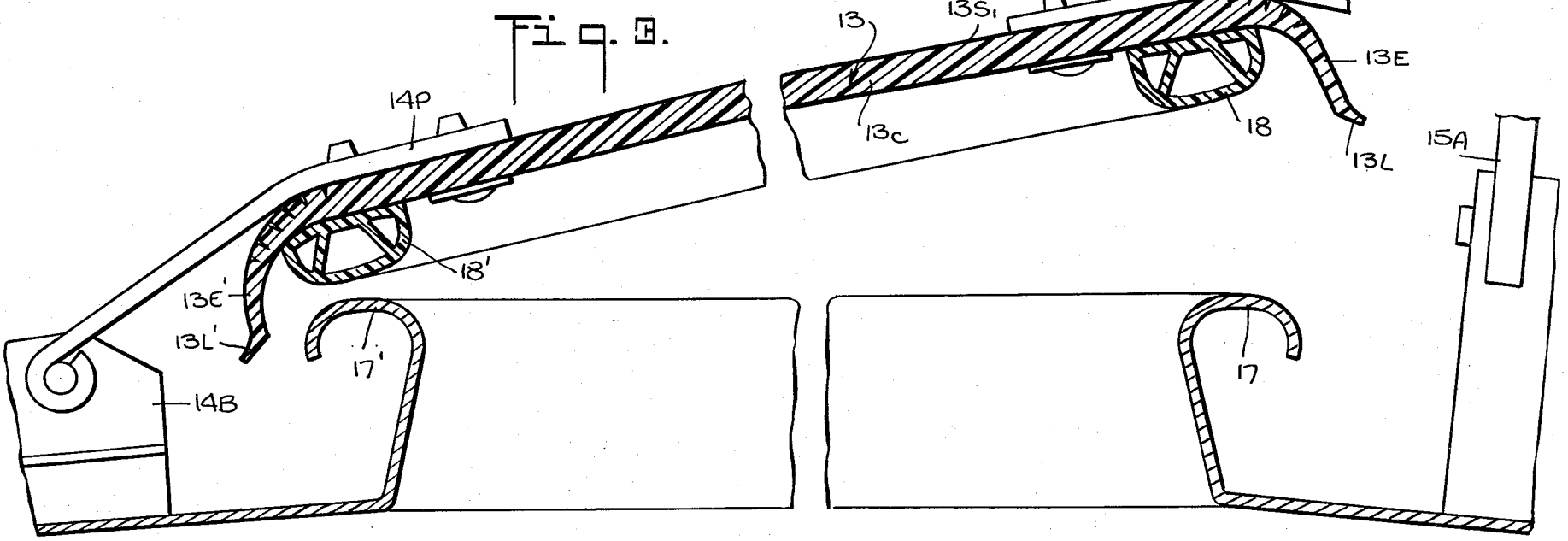
FIG. 3 is the same as FIG. 2 except that the cover is shown in a partially-raised position.

The extruded gasket material, as is evident in FIGS. 2 and 3, is of hollow construction having an arched cross-section, with a pair of oppositely-angled integral struts therein which serve to resist compression, whereby when the cover is pressed down on the coaming and latched to the roof, the compressed gaskets then form with the coaming a tight, impermeable seal.

Cover 13 is formed by a structural sandwich laminate constituted by a core panel 13C of end grain balsa wood to whose upper and lower faces are laminated thin inner and outer skins $13S_1$ and $13S_2$. The cover has a slightly vaulted or convex configuration, with rolled edges 13E and 13E' having outwardly extending lips 13L and 13L'. These rolled edges, when the cover is closed, serve to protectively shield the coaming 17 and 17' and the gaskets 18 and 18' pressed thereagainst, so that rain which runs off the vaulted surface of the cover is diverted away from the coaming.

The balsa core 13C of the cover laminate, in one practical embodiment, has a thickness of ½ inch and is of the end grain type. Balsa is the lightest of commercial woods, averaging less than nine pounds per cubic foot, balsa being derived from a fast-growing tree found in Central and South America. After being converted into lumber and kiln-dried, balsa is not subject to decay if used properly.

Balsa's cell structure affords a combination of high rigidity and compressive and tensile strength far superior to any composite or synthetic material of equal or higher density. It is known that end grain balsa is capable of supporting far greater loads than flat grain balsa of the same density, and that low density balsa material in the end grain direction will support greater loads than flat grain material of higher density.

A structural sandwich laminate is fabricated by adhesively bonding thin facings of high tensile and compressive strength to the core material. Laminates of high strength-to-weight ratio can be realized by combining the superior properties of end grain balsa wood cores with the required facing material. The main function of the bonded core material in the sandwich is to stabilize and stiffen the thin facings so that the major part of the load is borne by the skins. The bonded core converts the two skins into a unitary structure of great rigidity so that they deform much less under load than they would unjoined. To serve this purpose, the core material must possess high compressive shear and tensile strength and a high modulus of rigidity in shear, these characteristics being found in end grain balsa.

Facings 13S$_1$ and 13S$_2$ are preferably of reinforced fiberglass of a thickness of about 3/64 inch. Each facing is produced by a fiberglass cloth or matting bonded to the balsa core by a polyester resin, an epoxy or other suitable bonding agents which, when cured, form a fiberglass reinforced thin plastic skin. The outer surface of the cover is rendered skid-proof by adding sand to the resin coating. In practice, the cover may be made by a vacuum bagging technique in a male mold to which the balsa panel is conformed, using a single chopped fiberglass matting and a suitable resin to achieve a 70/30 resin-to-glass ratio.

Figures 6, 7, 8, 9:
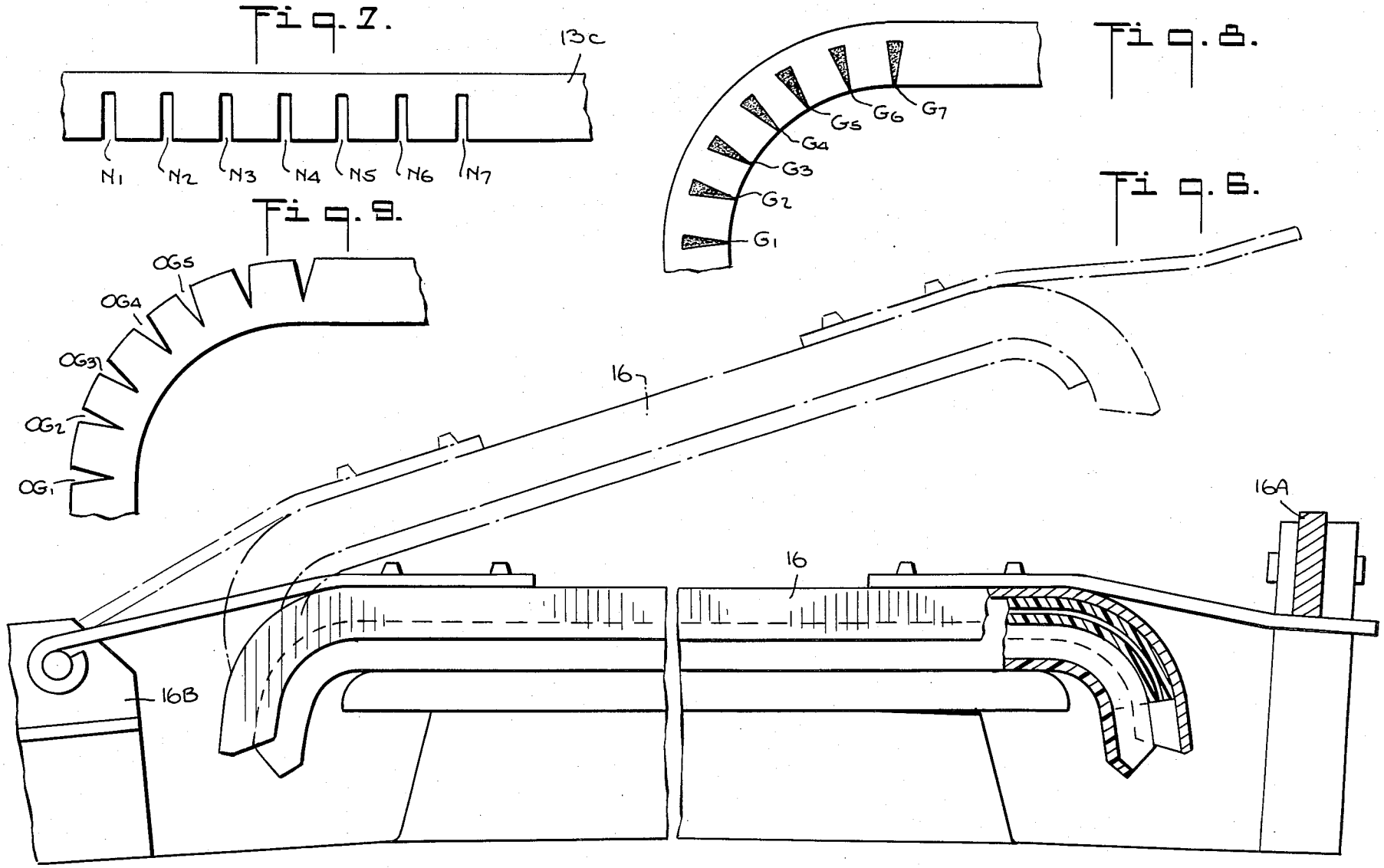
FIG. 6 is a transverse section taken in the plane indicated by lines 6—6 in FIG. 1, the hold-down bar being shown in both its clamped and released position.
FIG. 7 shows the grooves cut in the long edges of the balsa wood core panel to facilitate curving of the edge.
FIG. 8 shows how curving of the edge closes the notches; to create triangular notches.
FIG. 9 shows an alternative technique to facilitate curving of the edge of the panel.

The balsa core is constituted by a single rectangular panel having the desired thickness, length and width dimensions. In order to roll the edges, the edges, as shown in FIG. 7 are cut at their underside to create a series of longitudinally-extending notches $N_1$, $N_2$, $N_3$ etc. in parallel relation which, in practice, may be ⅛ inch wide. When, as shown in FIG. 8, each edge is then rolled, the notch walls incline toward each other to create closed triangular gaps $G_1$, $G_2$, $G_3$ etc.

Alternatively, as shown in FIG. 9, to roll the edges, one may cut a series of longitudinally-extending slits in parallel relation on the upper side of the panel, which slits, when the edge is rolled, create open triangular gaps $OG_1$, $OG_2$, $OG_3$ etc. These gaps, when a flowing resin bonding agent is applied to the surface of the panel to effect lamination of the facing skin thereto, are penetrated by and filled with the resin to produce, when cured, resin inserts which act to strengthen these rolled edges and maintain their curved formation.

Figure 4:
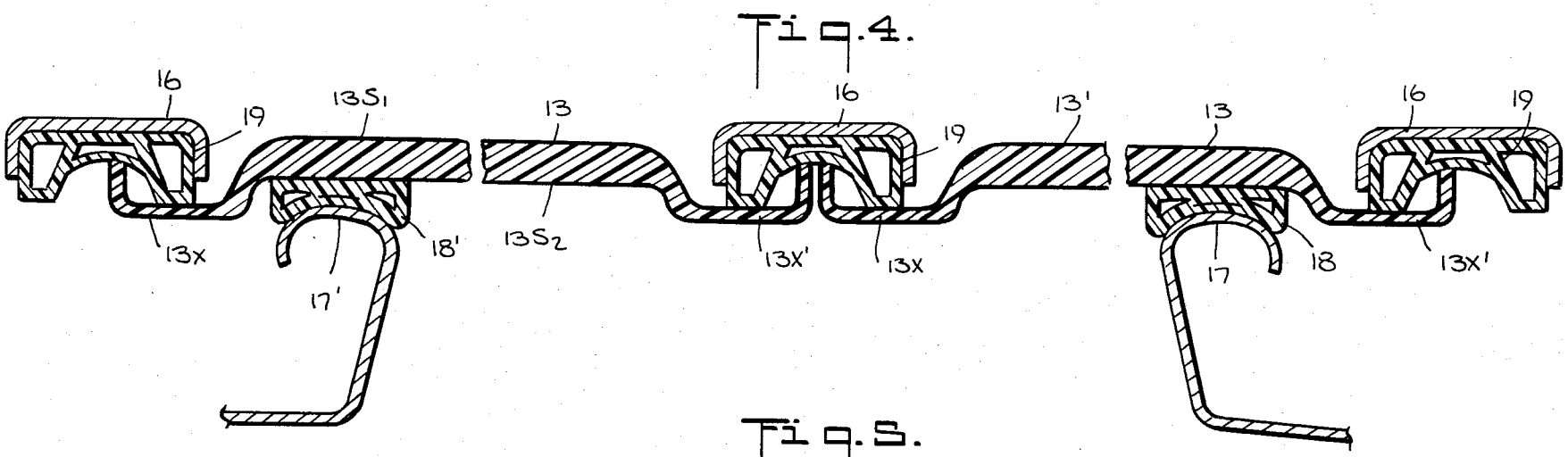
FIG. 4 is a longitudinal section in the plane indicated by lines 4—4 in FIG. 1, with the hold-down bars which engage the ends of the covers shown in their clamped position.
Figure 5:
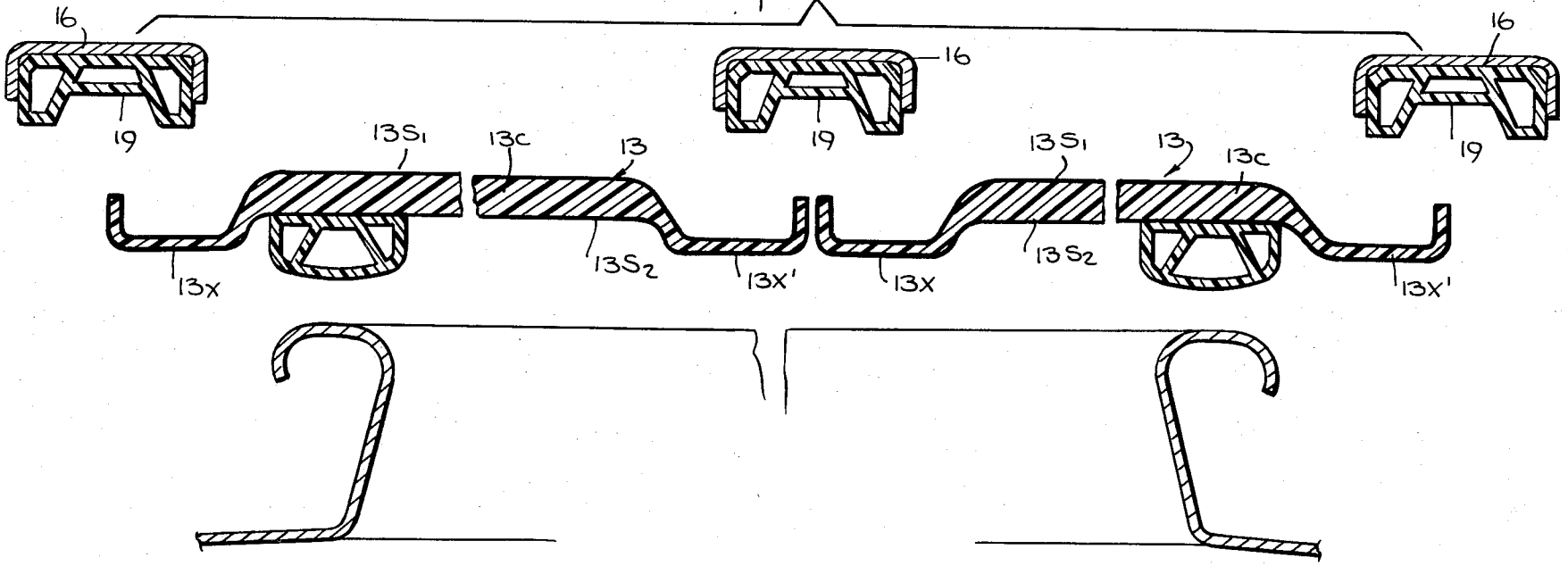
FIG. 5 is the same as FIG. 4, but with the hold-down bars released from the covers.

The opposite ends of covers 13, as shown in FIGS. 4 and 5, are defined by marginal extensions of the facing skins 13F and 13F$_2$ which go beyond the core panel and are shaped in a mold to form channel-shaped flanges 13X and 13X'. These flanges cooperate with hold-down bars 16 which have an opposed channel formation within each of which is nested an extruded gasket 19. This gasket has an A-frame cross-section and possesses properties similar to gasket 18. This hold-down bar 16 at one end of cover 13 cooperates with and seals flange 13X of this cover, while bar 16 at the junction of the other end of cover 13 and the adjacent end of cover 13' cooperates with and seals the associated flanges 13X' and 13X, whereas bar 16 at the other end of cover 13' cooperates with flange 13X' of this cover.

While the invention has been described in terms of hatch covers for railway hopper cars in which a set of covers serve to close and open an elongated rectangular hatch whose perimeter is delineated by a coaming, it will be appreciated that a similar hatch cover structure which incorporates a light-weight balsa wood core laminated to thin skins may be used for covering other hatches, such as hatch-covered cargo holds in ocean-going dry bulk carriers. Where a cargo is stored in a refrigerated hold that is thermally insulated to maintain a desired temperature level, the use of hatch covers of the type disclosed herein serves to extend the thermal insulation to the covers and therefore minimizes heat transfer losses through the covers.

While there has been shown and described a preferred embodiment of hatch covers for railway hopper cars in accordance with the invention, it will be appreciated that many changes and modifications may be made therein without, however, departing from the essential spirit thereof.

I claim:

1. A set of at least two light-weight covers of high strength and rigidity adapted to sealably close a rectangular hatch in the wall of a structure such as a railway hopper car having a walkway on each side of the hatch, said hatch having a coaming running along its perimeter, each cover closing a respective portion of the hatch and comprising:

(A) an end grain balsa wood core panel, the edges of the panel having a plurality of longitudinally extending cuts extending partially therein to permit rolling of the edges;

(B) thin inner and outer skins bonded to the faces of the panel and covering the edges thereof to form a sandwich laminate of high rigidity, structural strength and providing thermal insulation;

(C) compressible gaskets secured to the underside of the laminate adjacent the edges thereof to engage and press against the coaming to seal said hatch, the edges of the laminate being in a rolled formation to define canopies which protectively shield the coaming and the gaskets;

(D) means hinging the cover to one side of the structure; and (E) means latching the cover to the other side of the structure.

2. A set of covers as set forth in claim 1, wherein said gaskets are formed of an extruded elastomeric material of an arched cross-section having integral struts therein to resist compression.

3. A set of covers as set forth in claim 1, wherein each cover has a slightly vaulted formation to shed water.

4. A set of covers as set forth in claim 1, wherein said skins are formed by fiberglass laminated to said faces by a synthetic resin to form a reinforced plastic skin.

5. A set of covers as set forth in claim 4, wherein the resin in the outer surface of the cover has sand embedded therein to impart skid-proof properties to the cover.

6. A set of covers as set forth in claim 4, wherein said skins are extended beyond the ends of the panel and are interlaminated to form channel-shaped flanges which cooperate with hold-down bars having an opposing channel formation.

7. A set of covers as set forth in claim 6, wherein said hold-down bars have compressible gaskets nested therein.

* * * * *